US009616662B2

(12) United States Patent
Kitaoka et al.

(10) Patent No.: US 9,616,662 B2
(45) Date of Patent: Apr. 11, 2017

(54) IMAGE FORMING APPARATUS AND HEAD DRIVE METHOD

(71) Applicants: Naoko Kitaoka, Kanagawa (JP); Takahiro Yoshida, Ibaraki (JP)

(72) Inventors: Naoko Kitaoka, Kanagawa (JP); Takahiro Yoshida, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/730,423

(22) Filed: Jun. 4, 2015

(65) Prior Publication Data

US 2015/0375504 A1 Dec. 31, 2015

(30) Foreign Application Priority Data

Jun. 30, 2014 (JP) ..... 2014-134643

(51) Int. Cl.
*B41J 29/38* (2006.01)
*B41J 2/045* (2006.01)

(52) U.S. Cl.
CPC ..... *B41J 2/04588* (2013.01); *B41J 2/04573* (2013.01); *B41J 2/04581* (2013.01); *B41J 2202/20* (2013.01)

(58) Field of Classification Search
USPC ..... 347/5, 9, 10, 11, 12, 15
See application file for complete search history.

(56) References Cited

U.S. PATENT DOCUMENTS 6,328,397 B1 12/2001 Shimizu et al.
8,752,925 B2 * 6/2014 Norigoe ..... B41J 2/04581 347/10
2003/0025744 A1 * 2/2003 Nou ..... 347/10
2007/0146403 A1 * 6/2007 Sayama ..... B41J 2/04541 347/10

FOREIGN PATENT DOCUMENTS

JP 64-056556 3/1989
JP 2-001310 1/1990
JP 3-290257 12/1991
JP 3-293144 12/1991
JP 4-083648 3/1992
JP 4-357036 12/1992

(Continued)

*Primary Examiner* — Lam Nguyen
(74) *Attorney, Agent, or Firm* — Cooper & Dunham LLP

(57) ABSTRACT

An image forming apparatus includes a liquid discharging head unit including multiple nozzles to discharge liquid droplets, individual liquid chambers communicated to the multiple nozzles, and pressure generating units to generate pressure applied to a liquid in the individual liquid chambers; and a head drive control unit to generate a common driving waveform including multiple discharging pulses arranged in time series within one driving cycle of discharging liquid droplets of the liquid, to select at least one of the multiple discharging pulses from the common driving waveform, and to apply the selected at least one of the discharging pulses to the pressure generating units. The common driving waveform, generated by the head drive control unit, include at least a first discharging pulse and a second discharging pulse for discharging liquid droplets of same size.

7 Claims, 13 Drawing Sheets

(56) References Cited

FOREIGN PATENT DOCUMENTS

| | | |
|---|---|---|
| JP | 10-016212 | 1/1998 |
| JP | 10-244670 | 9/1998 |
| JP | 11-138797 | 5/1999 |
| JP | 2000-079684 | 3/2000 |
| JP | 2003-053957 | 2/2003 |
| JP | 2005-280273 | 10/2005 |
| JP | 2006-035803 | 2/2006 |
| JP | 2006-224387 | 8/2006 |
| JP | 2007-168216 | 7/2007 |
| JP | 2007-313757 | 12/2007 |
| JP | 2012-116040 | 6/2012 |

* cited by examiner

IMAGE FORMING APPARATUS AND HEAD DRIVE METHOD

CROSS-REFERENCE TO RELATED APPLICATION

This patent application is based on and claims priority pursuant to 35 U.S.C. §119 from Japanese Patent Application No. 2014-134643, filed on Jun. 30, 2014 in the Japan Patent Office, which is hereby incorporated by reference herein in its entirety.

BACKGROUND

Technical Field

Exemplary embodiments of the present disclosure generally relate to an image forming apparatus and a head drive method.

Description of the Related Art

Image forming apparatuses of a liquid discharge recording type that employ a recording head, serving as a liquid discharging head to discharge liquid droplets, are known. For example, an inkjet recording apparatus is an image forming apparatus of the liquid discharge recording type.

With regards to the liquid discharging head, increase in density of nozzles of the liquid discharging head is progressing in order to form a high quality image with the liquid discharging head. Thus, there is a trend of pitch between the nozzles becoming smaller, and width of a partition wall between individual liquid chambers of each of the nozzles becoming thinner.

Accordingly, speed of discharging the liquid droplets from a nozzle change depending upon whether or not an adjacent nozzle discharges with respect to the nozzle that is discharging. More specifically, a configuration of the trend is prone to an adjacent crosstalk phenomenon that makes impact points, with respect to a recording medium, of the discharged liquid droplets out of alignment.

There are conventional technologies that reduce an influence of the adjacent crosstalk phenomenon by making driving cycles of adjacent nozzles different. However, due to differing the driving cycles of adjacent nozzles, driving frequency declines. Thus, a decline with respect to printing speed occurs. In addition, there is an issue of an increase with respect to pitch between dots formed by liquid droplets due to impact points, with respect to the recording medium, of the liquid droplets being shifted.

SUMMARY

In view of the foregoing, in an aspect of this disclosure, there is provided a novel image forming apparatus including a liquid discharging head unit including multiple nozzles to discharge liquid droplets, individual liquid chambers communicated to the multiple nozzles, and pressure generating units to generate pressure applied to a liquid in the individual liquid chambers; and a head drive control unit to generate a common driving waveform including multiple discharging pulses arranged in time series within one driving cycle of discharging liquid droplets of the liquid, to select at least one of the multiple discharging pulses from the common driving waveform, and to apply the selected at least one of the discharging pulses to the pressure generating units. The common driving waveform, generated by the head drive control unit, include at least a first discharging pulse and a second discharging pulse for discharging liquid droplets of same size. When discharging liquid droplets of the same size from adjacent nozzles of the multiple nozzles that are adjacent in a nozzle array direction, the head drive control unit applies the first discharging pulse to the pressure generating unit of one nozzle of the adjacent nozzles and the second discharging pulse to the pressure generating unit of the other nozzle of the adjacent nozzles.

These and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
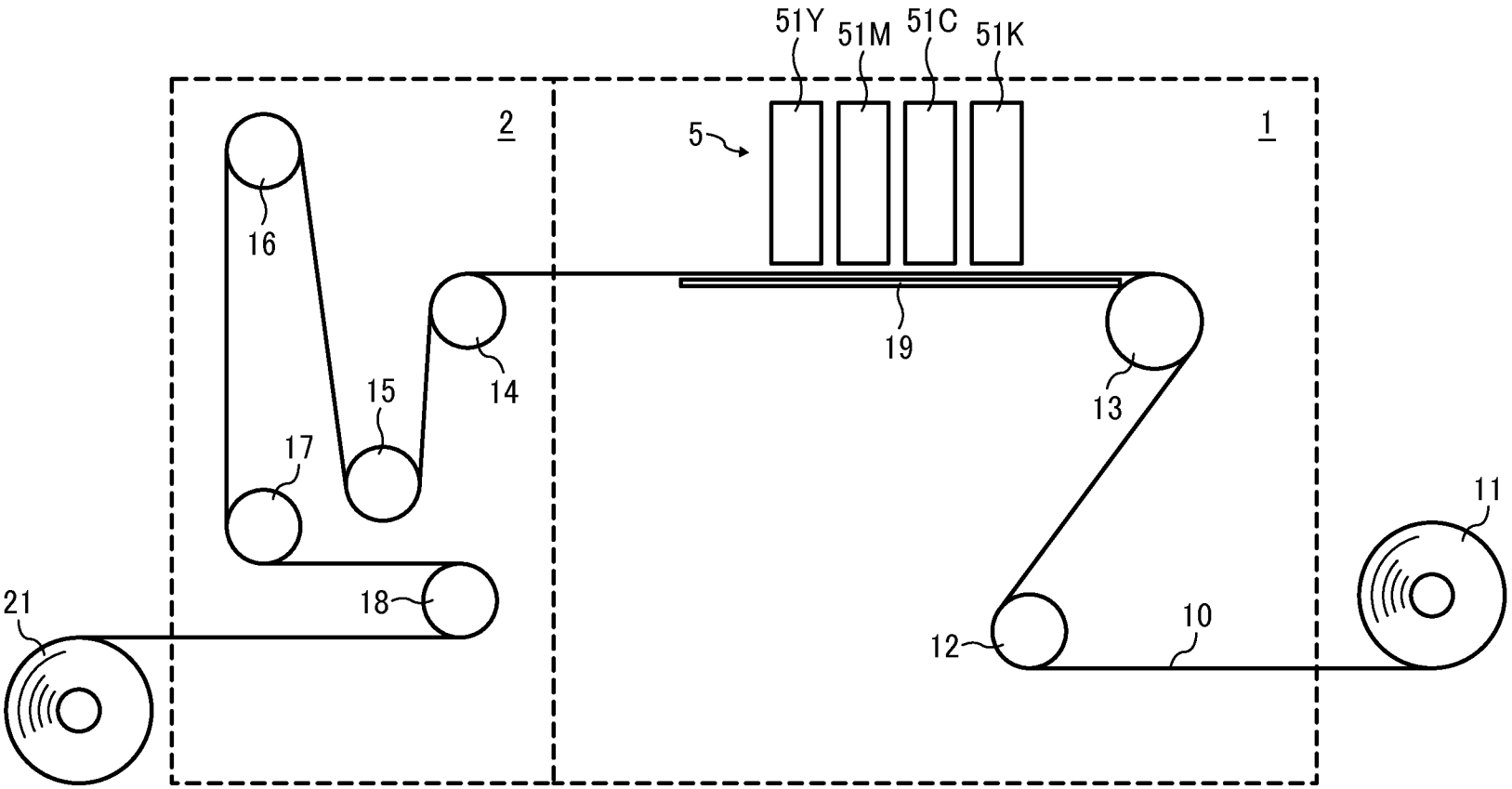
FIG. 1 is a schematic view of an example of an image forming apparatus according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but may be modified and improved within the scope of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

In a later-described comparative example, illustrative embodiment, and alternative example, for the sake of simplicity, the same reference numerals will be given to constituent elements such as parts and elements having the same functions, and redundant descriptions thereof omitted.

There is provided a novel image forming apparatus and a head drive method that does not increase pitch between dots of liquid droplets and reduces an adjacent crosstalk phenomenon.

The following is a description of an example of the image forming apparatus according to an embodiment of the present invention with reference to FIG. 1. FIG. 1 is a schematic view of the example of the image forming apparatus according to the embodiment of the present invention.

The image forming apparatus of FIG. 1 is a full-line inkjet recording device including a device body 1 and an exit unit 2, to obtain drying time, that are juxtaposed to each other.

The image forming apparatus conveys, with conveyance rollers 12 to 18, a recording medium 10 that is a continuous sheet unwound from an unwinding roller 11 to a winding roller 21 that winds the recording medium 10.

The recording medium 10, in between a first conveyance roller 13 and a second conveyance roller 14, is conveyed on a conveyance guide member 19 while facing an image forming unit 5. An image is formed on the recording medium 10 with liquid droplets discharged from the image forming unit 5.

The image forming unit 5 includes, for example, four full-line recording heads 51K, 51C, 51M, and 51Y corresponding to four colors. The four full-line recording heads 51K, 51C, 51M, and 51Y are provided, for example, from an upstream side of a conveyance direction of the recording medium 10. The four full-line recording heads 51K, 51C, 51M, and 51Y discharge, with respect to the conveyed recording medium 10, liquid droplets of black (K), cyan (C), magenta (M), and yellow (Y), respectively. The generic term "recording heads 51" is used hereinafter when no distinction is made with respect to colors. It is to be noted that colors and number of colors are not limited to the above-described example.

Figure 2:
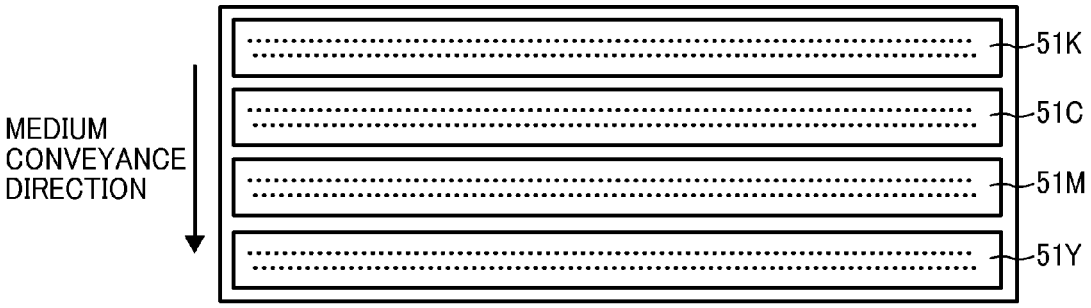
FIG. 2 is a plan view of an example of a recording head of the image forming apparatus.
Figure 3:
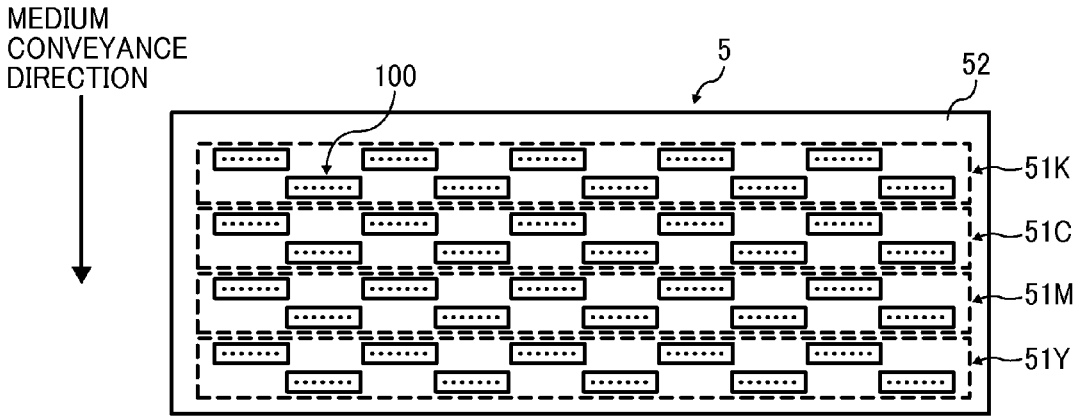
FIG. 3 is a plan view of another example of the recording head of the image forming apparatus.

As shown in FIG. 2, each of the recording heads 51 may be a single head corresponding to a full-line recording head. Further, each of the recording heads 51 may also be a head array with multiple short length heads 100, arranged with respect to a width of the recording medium 10, provided in a zigzagging arrangement on a base member 52 to form a full-line recording head as shown in FIG. 3. With respect to the above-described example of FIG. 1, each of the recording heads 51 is configured of a liquid discharging head unit including a liquid discharging head and a head tank to supply liquid to the liquid discharging head. It is to be noted that a configuration of each of the recording heads 51 is not limited to the above-described example. Each of the recording heads 51 may also be configured of a liquid discharging head singly.

Figure 4:
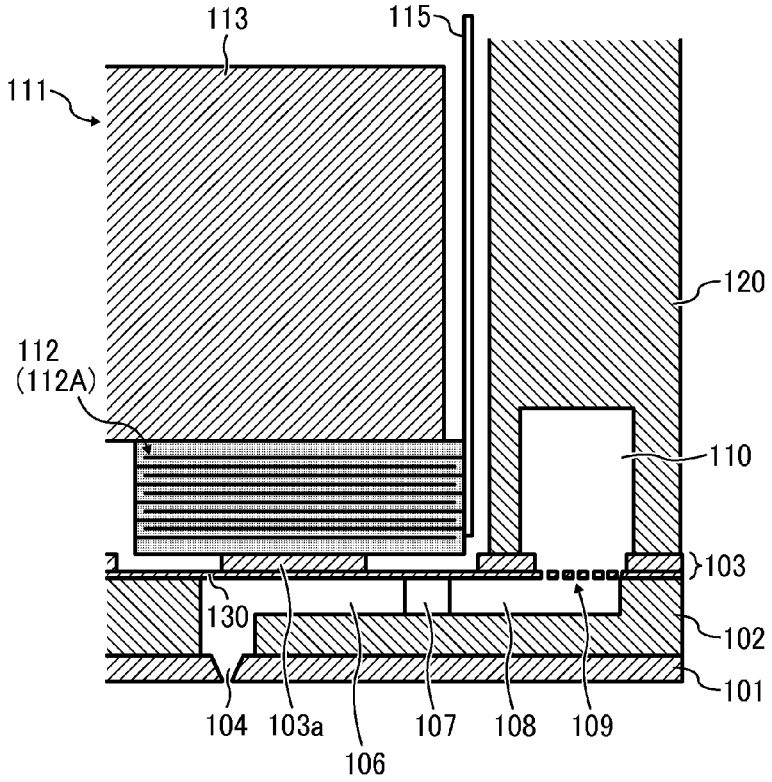
FIG. 4 is a cross-sectional view of an example of a configuration of a liquid discharging head (i.e., head chip) of the recording head from a viewpoint of a direction of a longer side of a liquid chamber orthogonal to a direction of a nozzle array.
Figure 5:
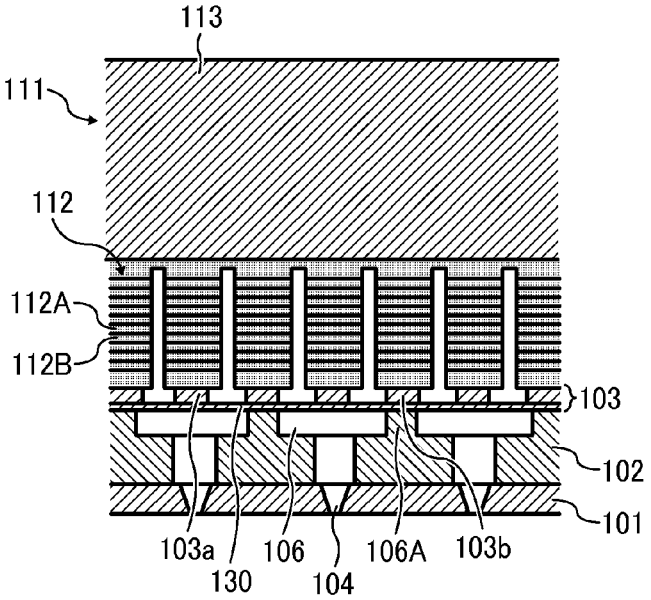
FIG. 5 is a cross-sectional view of the example of the configuration of the liquid discharging head (i.e., head chip) of the recording head from a viewpoint of a direction of a shorter side of the liquid chamber along the direction of the nozzle array.

The following is a description of an example of a configuration of the liquid discharging head (i.e., head chip) of the recording heads 51 with reference to FIG. 4 and FIG. 5. FIG. 4 is a cross-sectional view of the example of the configuration of the liquid discharging head of the recording heads 51 from a viewpoint of a direction of a longer side of a liquid chamber orthogonal to a direction of a nozzle array. FIG. 5 is a cross-sectional view of the example of the configuration of the liquid discharging head of the recording head from a viewpoint of a direction of a shorter side of the liquid chamber along the direction of the nozzle array.

The liquid discharging head includes a nozzle plate 101, a channel plate 102 (i.e., liquid chamber substrate), and a vibrating plate member 103 that are joined. The liquid discharging head further includes a piezoelectric actuator 111 to displace the vibrating plate member 103, and a frame member 120 serving as a common channel member.

With the above-described configuration, individual liquid chambers 106 (hereinafter may also be referred to as pressure chambers or pressure applying chambers) communicated to multiple nozzles 104 that discharge the liquid droplets are formed. Further, a liquid supplying channel 107, that also serves as a fluid resistance member, to supply a liquid to the individual liquid chambers 106 and a liquid introduction member 108 communicated to the liquid supplying channel 107 are formed. Adjacent individual liquid chambers 106 are separated by separating walls 106A along the direction of the nozzle array.

The liquid is supplied to the individual liquid chambers 106 from a common liquid chamber 110 serving as a common channel of the frame member 120 via a filter member 109 formed at the vibrating plate member 103, the liquid introduction member 108, and the liquid supplying channel 107.

The piezoelectric actuator 111 is provided opposite to the individual liquid chambers 106 via vibrating areas 130, that are deformable, of the vibrating plate member 103 constituting walls of the individual liquid chambers 106.

The piezoelectric actuator 111 includes multiple laminated piezoelectric members 112 joined to a base member 113. More specifically, with respect to a single laminated piezoelectric member 112, the single laminated piezoelectric member 112 is formed into a comb teeth shape, with a predetermined interval, having a desired number of first column shaped piezoelectric elements 112A (hereinafter may also be referred to as first piezoelectric columns) and second column shaped piezoelectric elements 112B (hereinafter may also be referred to as second piezoelectric columns) by half-cut dicing to form grooves.

The first piezoelectric columns 112A and the second piezoelectric columns 112B of the single laminated piezoelectric member 112 are the same in configuration. However, they are differentiated as follows. The first piezoelectric columns 112A are driving piezoelectric columns 112A (hereinafter may also be referred to as driving columns) for driving by applying a driving wave. The second piezoelectric columns 112B are non-driving piezoelectric columns 112B (hereinafter may also be referred to as non-driving columns) and are simply employed as columns with no application of the driving wave.

The driving columns 112A are joined to first island shaped protruding portions 103*a* formed at the vibrating areas 130 of the vibrating plate member 103. The non-driving columns 112B are joined to second island shaped protruding portions 103*b* of the vibrating plate member 103.

The single laminated piezoelectric member 112 is formed of alternately laminating a piezoelectric layer and an internal electrode. More specifically, each of the internal electrodes are drawn out to an end surface of the laminated piezoelectric member 112 to be provided with external electrodes, and a flexible printed circuit 115 (hereinafter referred to as FPC) serving as a flexible wiring substrate having flexibility is connected to the external electrodes to apply driving signals to the external electrodes of the single laminated piezoelectric member 112.

The frame member 120 is formed with injection molding employing, for example, an epoxy based resin or a thermoplastic resin such as polyphenylene sulfide. The common liquid chamber 110 that is supplied with the liquid from the head tank or from a liquid cartridge is formed in the frame member 120.

The following is a description of an example of a driving method of the above-described liquid discharging head. With respect to the liquid discharging head configured as described above, by decreasing a voltage applied to the driving columns 112A below a reference potential, the driving columns 112A contract. Accordingly, the vibrating areas 130 of the vibrating plate member 103 displace upwards (in FIG. 4) from initial positions, volume of the individual liquid chambers 106 increase, and the liquid flows into the individual liquid chambers 106.

When the voltage applied to the driving columns 112A is increased, the driving columns 112A extend in a laminated direction. Accordingly, the vibrating areas 130 of the vibrating plate member 103 deform in a direction of the multiple nozzles 104, and volume of the individual liquid chambers 106 decrease. Thus, pressure is applied to the liquid in the individual liquid chambers 106. Accordingly, the multiple nozzles 104 discharge (i.e., spray) the liquid droplets of the liquid.

When the voltage applied to the driving columns 112A are returned to the reference potential, the vibrating areas 130 of the vibrating plate member 103 return to the initial positions, and a negative pressure is generated due to expansion of the individual liquid chambers 106. Accordingly, the liquid within the individual liquid chambers 106 is replenished from the common liquid chamber 110 via the liquid supplying channel 107. After a vibration of a meniscus surface of the multiple nozzles 104 attenuates and stabilizes, transition to an operation for next discharge of the liquid droplets is conducted.

It is to be noted that driving methods of the above-described liquid discharging head is not limited to the above-described example (i.e., pull-push-discharge). For example, the driving method may also be pull-discharge or push-discharge depending on application of a driving waveform.

Figure 6:
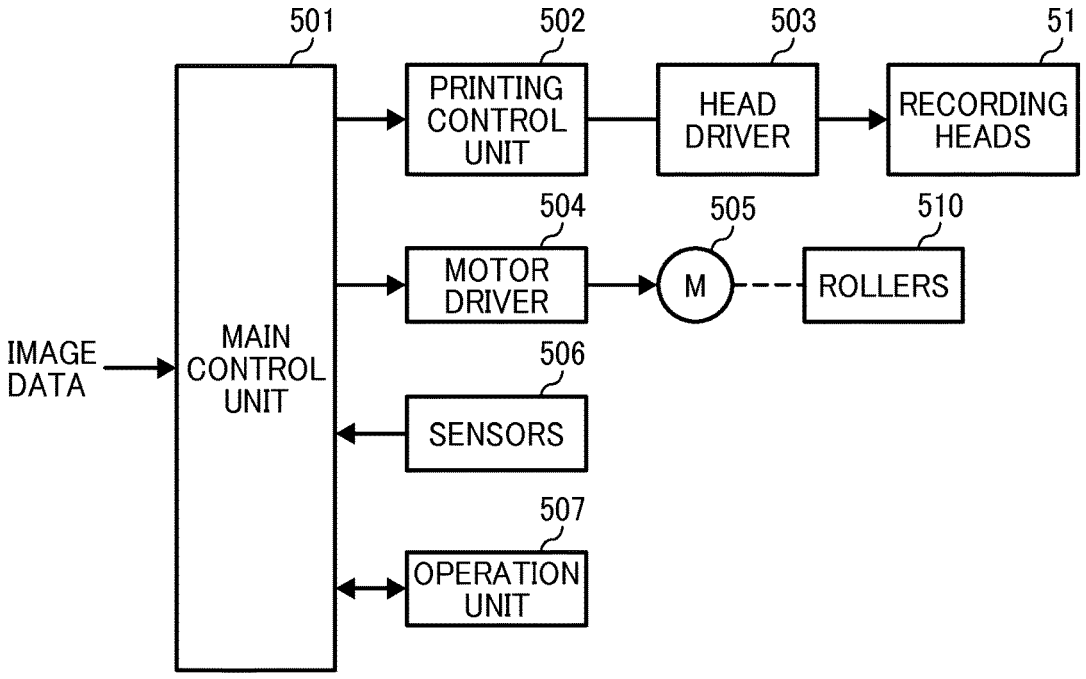
FIG. 6 is a block diagram of an example of a control unit of the image forming apparatus.

The following is a description of an example of a control unit of the image forming apparatus according to the embodiment of the present invention with reference to FIG. 6. FIG. 6 is a block diagram of the example of the control unit of the image forming apparatus of FIG. 1.

The control unit includes a main control unit 501 (hereinafter may also be referred to as system controller) implemented by a microcomputer that controls entire operation of the image forming apparatus and also serves as a head drive control unit according to an embodiment of the present invention, an image memory, and a communication interface. The main control unit 501 transfers printing data (i.e., image data) to a printing control unit 502 to form an image on a recording medium based on the image data and various command information transferred from an external information processing device (i.e., host).

The printing control unit 502 serially transfers the image data received from the main control unit 501 to a head driver 503. Further, the printing control unit 502 outputs to the head driver 503, a latch signal or a transfer clock for transfer of the image data and determination of transfer, a control signal, and a driving signal formed of one driving pulse or multiple driving pulses. The printing control unit 502 includes a drive waveform generating unit 701 implemented by a digital-to-analog (hereinafter referred to as D/A) converter that applies D/A conversion of pattern data of a common driving waveform Vcom stored in a read only memory (hereinafter referred to as ROM), a voltage amplifier, and an electric current amplifier.

The head driver 503 selects, based on the image data corresponding to one of the recording heads 51 that is serially inputted, a driving pulse of the common driving waveform Vcom applied by the printing control unit 502. Then, the head driver 503 applies the selected driving pulse to the multiple laminated piezoelectric members 112 serving as pressure generating units and causes the multiple nozzles 104 to discharge the liquid droplets. By selecting all or a portion of the driving pulse of the common driving waveform Vcom or by selecting all or a portion of a waveform element of the driving pulse, liquid droplets of different size can be selectively discharged to form dots of different size. For example, large liquid droplets, medium liquid droplets, and small liquid droplets can be selectively discharged.

The main control unit 501 controls, via a motor driver 504 and driving motors 505, various rollers 510 that include the unwinding roller 11, conveyance rollers 12 to 18, and the winding roller 21.

A detection signal from sensors 506 formed of various sensors is inputted to the main control unit 501. Input-output of various information and display information transactions are conducted between the main control unit 501 and an operation unit 507.

Figure 7:
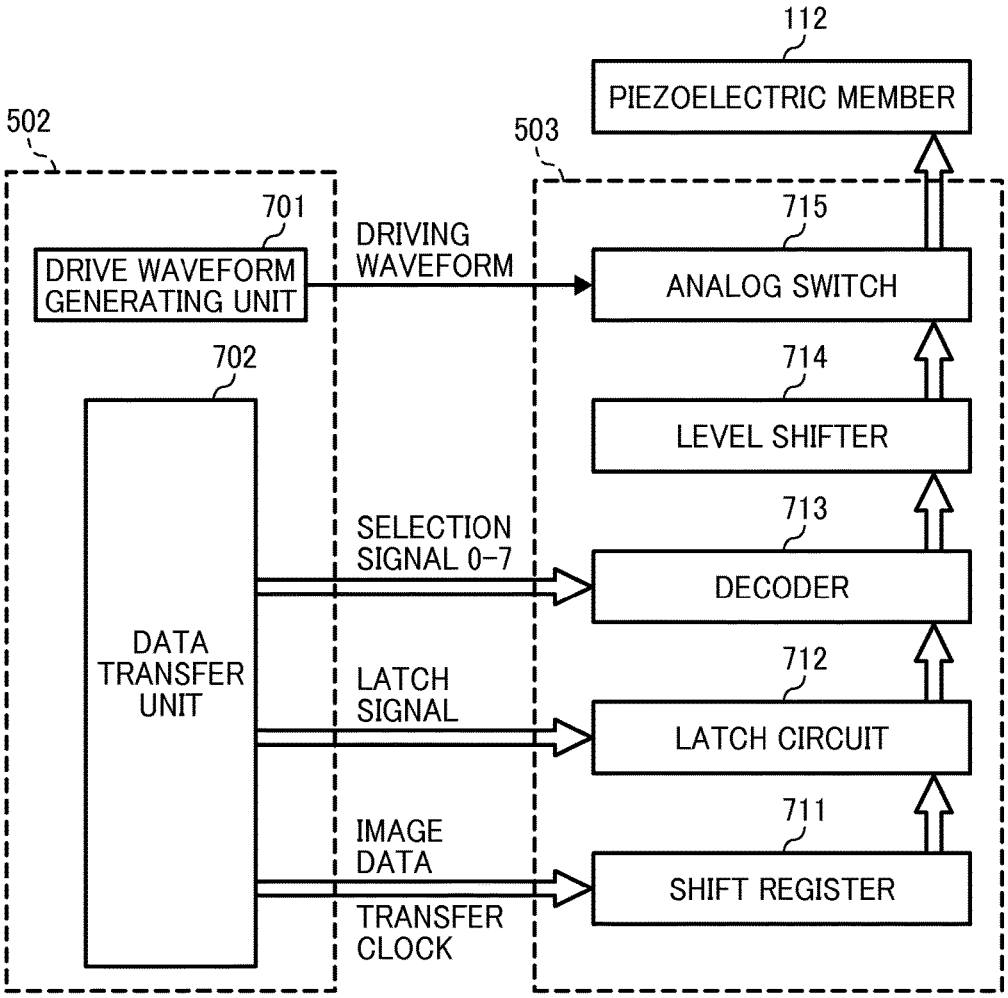
FIG. 7 is a block diagram of an example of a printing control unit and a head driver.

The following is a description of an example of the printing control unit 502 and the head driver 503 with reference to FIG. 7.

The printing control unit 502 includes the drive waveform generating unit 701 to generate and output the common driving waveform Vcom, and a data transfer unit 702. The data transfer unit 702 outputs two bits of the image data (i.e., gradation signal 0,1) according to a printing image, a clock signal, the latch signal (hereinafter may be referred to as LAT), and selection signals 0 to 7 that select the driving pulse of the common driving waveform Vcom.

From the drive waveform generating unit 701, the common driving waveform Vcom is generated and outputted. Within one printing cycle (i.e., one driving cycle) of the common driving waveform Vcom, multiple driving pulses (hereinafter may also be referred to as discharging pulses) are arranged in time series that make the multiple nozzles 104 discharge the liquid droplets.

The selection signals 0 to 7 are signals that instruct, with respect to each of the liquid droplets, turning one or off of an analog switch 715 serving as a switch unit of the head driver 503. Details of the analog switch 715 are described later. Transition to a state of H level (i.e., ON) is conducted with the driving pulse or the waveform element that is selected accordant with the printing cycle of the driving waveform Vcom, and a transition to a state of L level (i.e., OFF) is conducted at no selection.

The head driver 503 includes a shift register 711, a latch circuit 712, a decoder 713, a level shifter 714, and the analog switch 715.

The transfer clock (hereinafter may also be referred to as shift clock) and the serially imputed image data (i.e., gradation data: two bits/one channel (one nozzle)) are inputted to the shift register 711 from the data transfer unit 702. The latch circuit 712 latches each register value of the shift register 711 according to the latch signal. The decoder 713 decodes the gradation data and the selection signals 0 to 7, and outputs a result of decoding. The level shifter 714 converts a logic level voltage signal of the decoder 713 to a level at which the analog switch 715 is operable. The analog switch 715 turns ON/OFF (i.e., opens/closes) according to an output of the decoder 713 applied via the level shifter 714.

The analog switch 715 is connected to selected electrodes (i.e., individual electrodes) of each of the multiple laminated piezoelectric members 112. Accordingly, the common driving waveform Vcom from the drive waveform generating unit 701 is inputted to the analog switch 715. According to the serially transferred image data (i.e., gradation data) and the result of decoding the selection signals 0 to 7 from the decoder 713, the analog switch 715 is turned ON. Thus, the driving pulse or the waveform element of the common driving waveform Vcom passes through (more specifically, selected) the analog switch 715 and is applied to each of the multiple laminated piezoelectric members 112.

Figure 8:
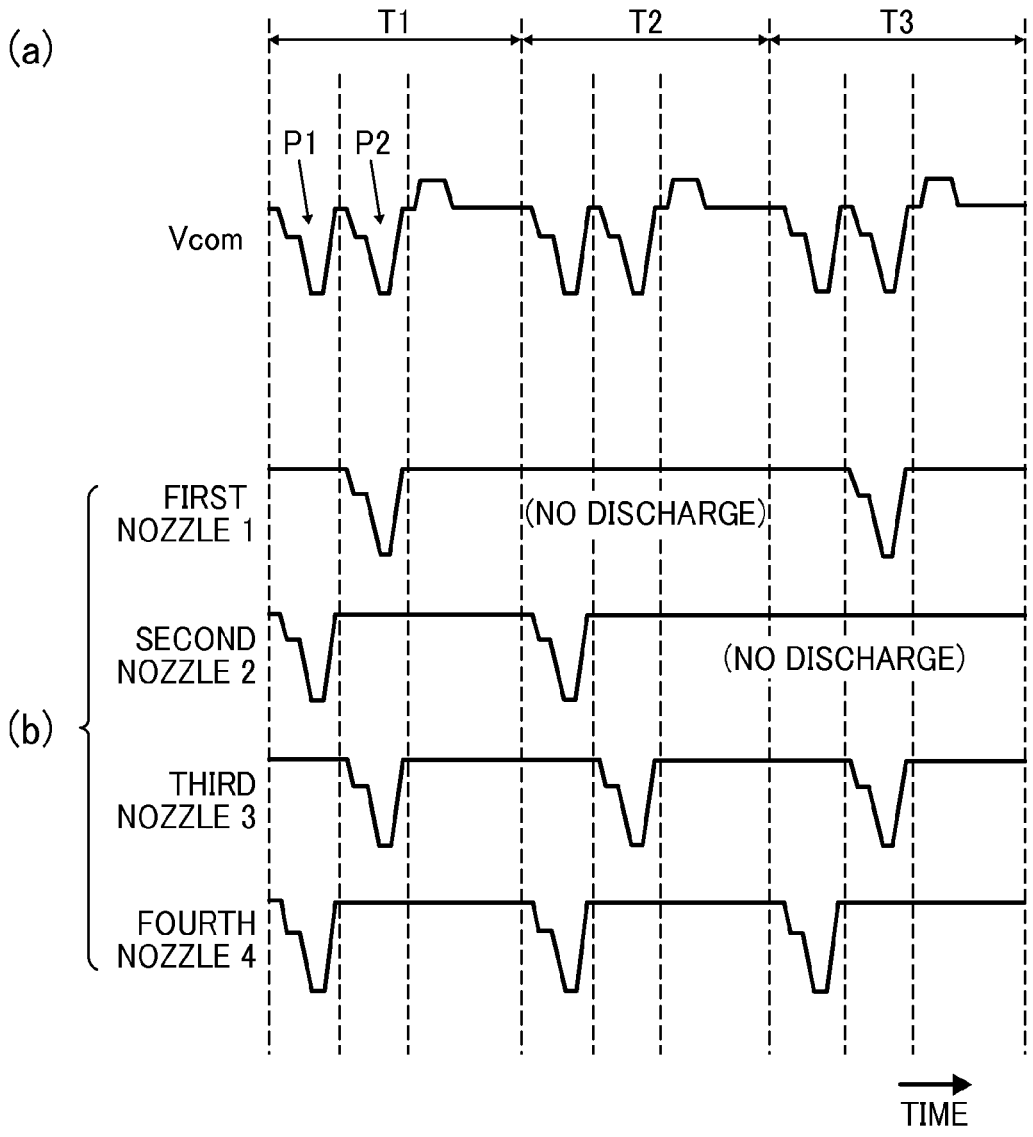
FIG. 8 is a graph of a common driving waveform and driving signals applied to pressure generating units of four nozzles, continuously arranged in a direction of a nozzle array, of example 1 according to an embodiment of the present invention.

The following is a description of example 1 according to an embodiment of the present invention with reference to FIG. 8. FIG. 8 is a graph of a common driving waveform Vcom and driving signals applied to pressure generating units of four nozzles, continuously arranged in a direction of a nozzle array, of example 1.

In FIG. 8, three cycles of driving pulses (i.e., discharging pulses), that make multiple nozzles 104 discharge small liquid droplets, of the common driving waveform Vcom are shown. The three cycles are represented by T1 to T3, respectively.

As shown in (a) of FIG. 8, the common driving waveform Vcom (hereinafter may be referred to as common driving signal) includes a first driving pulse P1 (hereinafter may also be referred to as first discharging pulse) and a second driving pulse P2 (hereinafter may also be referred to as second discharging pulse) within one cycle (hereinafter may also be referred to as one driving cycle or one printing cycle). The first discharging pulse P1 and the second discharging pulse P2 make the multiple nozzles 104 discharge liquid droplets of same size. In FIG. 8, the size of the liquid droplets is the smallest size (i.e., small liquid droplets), relatively.

In a context of FIG. 8, the first discharging pulse P1 and the second discharging pulse P2 have a relation of time of before and after. However, a speed difference is set to make the discharged liquid droplets of the first discharging pulse P1 and the second discharging pulse P2 impact an impacting surface (i.e., surface of a recording medium 10) at the same time. The speed difference is set by setting different waveform elements (e.g., falling waveform element, rising waveform element, holding waveform element).

As shown in (b) of FIG. 8, the four nozzles continuously arranged in the direction of the nozzle array are shown as a first nozzle 1 to a fourth nozzle 4. In a context of adjacent nozzles, the first discharging pulse P1 is selected and applied to the pressure generating unit of one nozzle of the adjacent nozzles and the second discharging pulse P2 is selected and applied to the pressure generating unit of the other nozzle of the adjacent nozzles.

In the context of FIG. 8, when the four nozzles are classified into odd number nozzles and even number nozzles, the odd number nozzles corresponding to the first nozzle 1 and the third nozzle 3 are applied with the second discharging pulse P2, and the even number nozzles corresponding to the second nozzle 2 and the fourth nozzle 4 are applied with the first discharging pulse P1.

Figure 9:
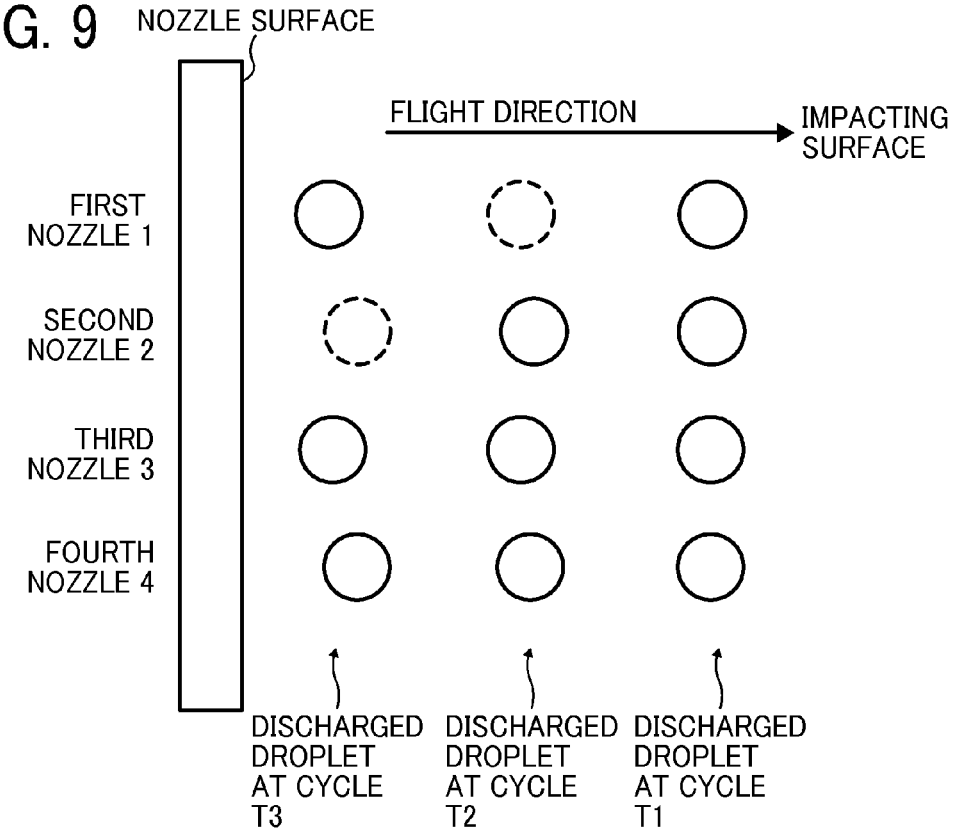
FIG. 9 is schematic view of a state of flight of liquid droplets when the driving signals of FIG. 8 are applied.
Figure 10:
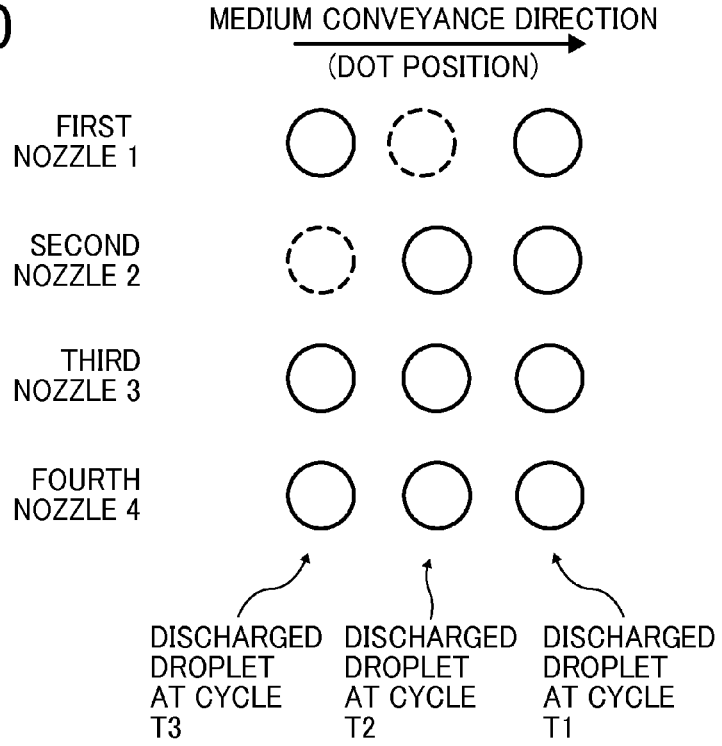
FIG. 10 is schematic view of a state of impact of the liquid droplets to a recording medium when the driving signals of FIG. 8 are applied.

The following is a description of operation of example 1 with reference to FIG. 9 and FIG. 10. FIG. 9 is schematic view of a state of flight of liquid droplets when the driving signals shown in (b) of FIG. 8 are applied. FIG. 10 is schematic view of a state of impact of the liquid droplets to the recording medium 10 when the driving signals shown in (b) of FIG. 8 are applied.

With the driving signals shown in (b) of FIG. 8, the first nozzle 1 to the fourth nozzle 4 discharge the liquid droplets in a first cycle T1. In a second cycle T2, the second nozzle 2 to the fourth nozzle 4 discharge the liquid droplets, and the first nozzle 1 does not discharge the liquid droplets. In a third cycle T3, the first nozzle 1, the third nozzle 3, and the fourth nozzle 4 discharge the liquid droplets, and the second nozzle 2 does not discharge the liquid droplets. (Hereinafter a nozzle among the first nozzle 1 to the fourth nozzle 4 that discharge the liquid droplets may also be referred to as discharging nozzle, and a nozzle among the first nozzle 1 to the fourth nozzle 4 that does not discharge the liquid droplets may also be referred to as non-discharging nozzle.)

As shown in FIG. 8, at the first discharging pulse P1, the second nozzle 2 and the fourth nozzle 4 discharge the liquid droplets. Then, at the second discharging pulse P2, the first nozzle 1 and the third nozzle 3 discharge liquid droplets. In FIG. 9, a broken-line circle represents a liquid droplet that was not discharged.

During flight, the liquid droplets discharged from the first nozzle 1 and the third nozzle 3 at the second discharging pulse P2 catch up to the liquid droplets discharged from the second nozzle 2 and the fourth nozzle 4 at the first discharging pulse P1, and all liquid droplets impact the impacting surface (i.e., surface of the recording medium 10) at almost the same time ("almost the same time" is defined as including all liquid droplets impacting the impacting surface at the same time).

When discharging the liquid droplets from the first nozzle 1 to the fourth nozzle 4, discharge timing of adjacent nozzles are differentiated. More specifically, among adjacent nozzles, there is always the non-discharging nozzle. Accordingly, speed of the discharged liquid droplets is made constant irrespective of discharging and non-discharging among adjacent nozzles.

Thus, a state of dots, formed by the liquid droplets discharged from the first nozzle 1 to the fourth nozzle 4, are formed on the recording medium 10 as shown in FIG. 10. Impact points of the liquid droplets on the recording medium 10 in a direction of conveyance of the recording medium 10 are not out of alignment (or are a little out of alignment).

With the above-described example 1, delay of impact of the liquid droplets, that form impact dots (i.e., dots), discharged from the discharging nozzle adjacent to the non-discharging nozzle is reduced. Accordingly, precision of the impact points is significantly enhanced, and color evenness or image quality of a line image is enhanced.

Figure 11:
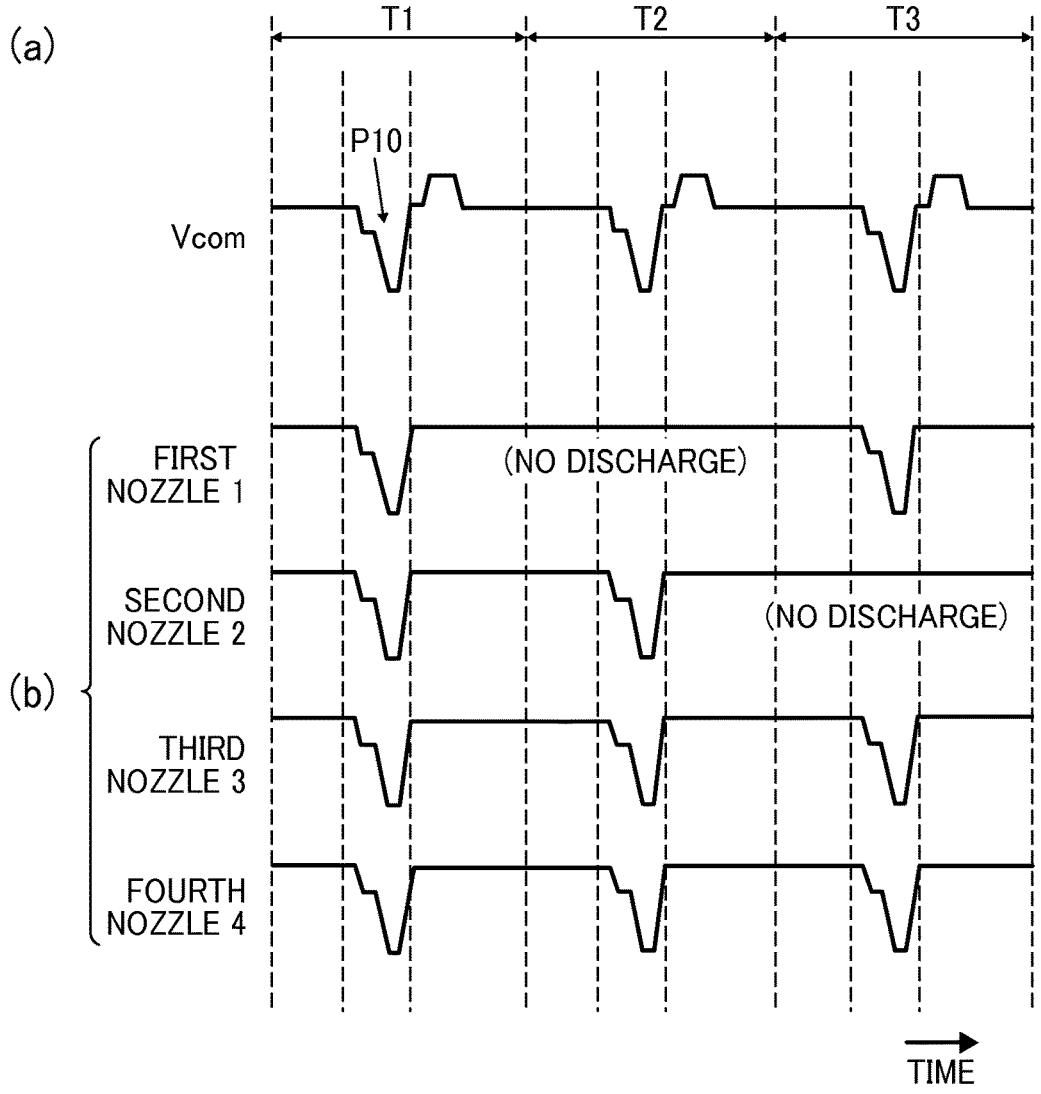
FIG. 11 is a graph of a common driving waveform and driving signals applied to pressure generating units of four nozzles, continuously arranged in a direction of a nozzle array, of comparative example 1.
Figure 12:
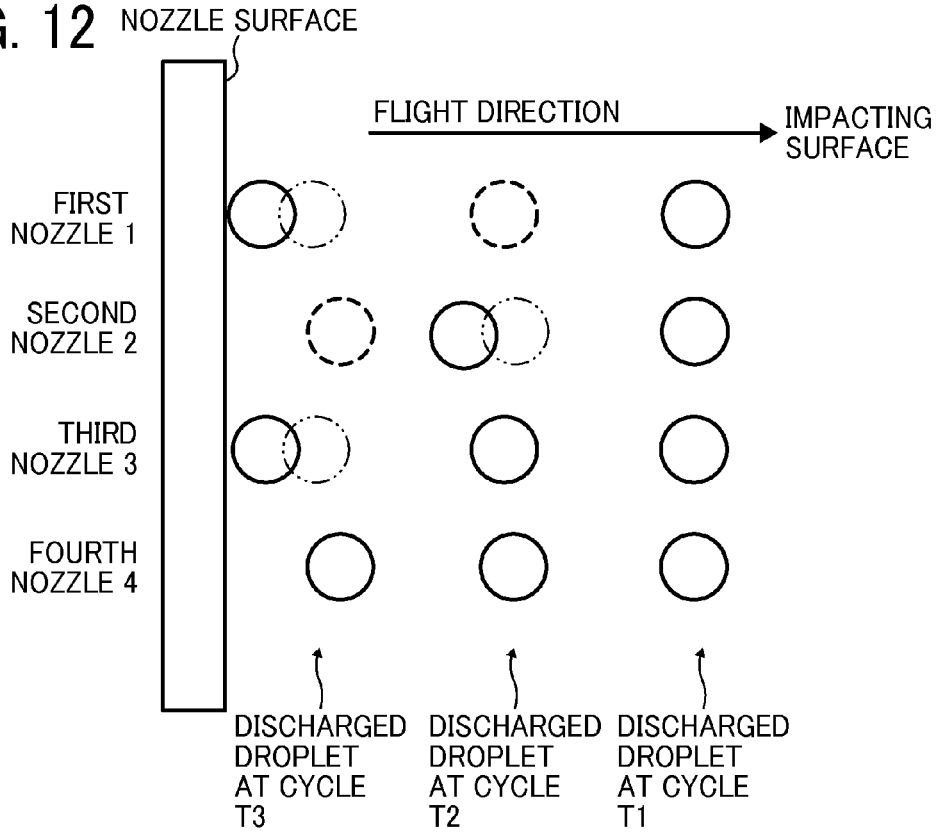
FIG. 12 is schematic view of a state of flight of liquid droplets when the driving signals of FIG. 11 are applied.
Figure 13:
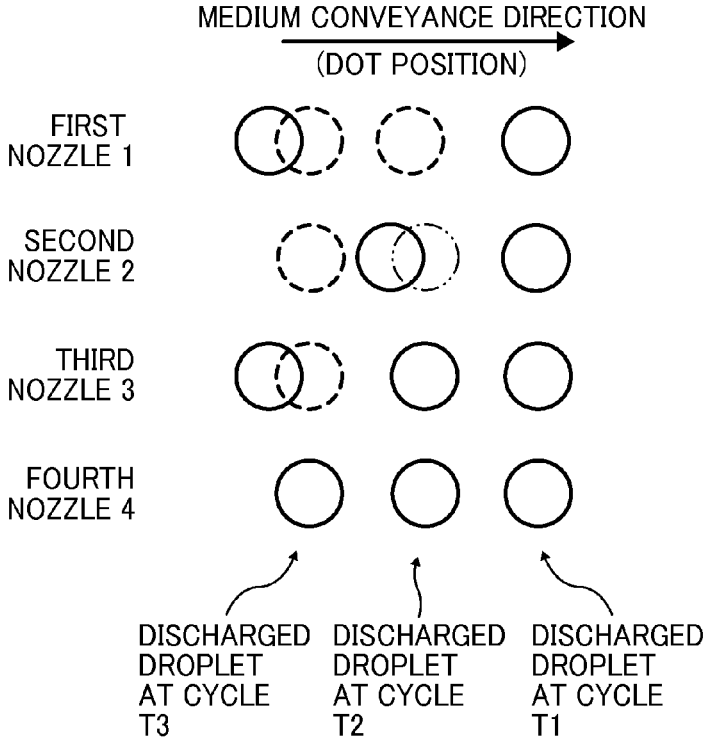
FIG. 13 is schematic view of a state of impact of the liquid droplets to a recording medium when the driving signals of FIG. 11 are applied.

The following is a description of comparative example 1 with reference to FIG. 11 to FIG. 13. FIG. 11 is a graph of driving signals applied to pressure generating units of four nozzles continuously arranged in a direction of a nozzle array and a common driving waveform with respect to the comparative example 1. FIG. 12 is schematic view of a state of flight of liquid droplets when the driving signals shown in (b) of FIG. 11 are applied. FIG. 13 is schematic view of a state of impact of the liquid droplets to a recording medium 10 when the driving signals shown in (b) of FIG. 11 are applied.

In the comparative example 1, a common driving waveform Vcom includes a single discharging pulse P10, for small liquid droplets, to generate and output the liquid droplets. Discharging nozzles to discharge the liquid droplets (i.e., small liquid droplets) are selected and applied with the discharging pulse P10.

With the driving signals shown in (b) of FIG. 11, a first nozzle 1 to a fourth nozzle 4 discharge the liquid droplets in a first cycle T1. In a second cycle T2, a second nozzle 2 to a fourth nozzle 4 discharge the liquid droplets, and the first nozzle 1 does not discharge the liquid droplets. In a third cycle T3, the first nozzle 1, a third nozzle 3, and the fourth nozzle 4 discharge the liquid droplets, and the second nozzle 2 does not discharge the liquid droplets.

In the second cycle T2, the first nozzle 1, that is adjacent to the second nozzle 2, is in a non-discharging state. In the third cycle T3, the second nozzle 2, that is adjacent to the first nozzle 1 and the third nozzle 3, is in a non-discharging state. More specifically, when individual liquid chambers 106 are applied with pressure, separating walls 106A separating the individual liquid chambers 106 deform toward the individual liquid chamber 106 corresponding to the nozzle 2 and allows pressure to escape.

Thus, in the second cycle T2, speed of the liquid droplets discharged from the second nozzle 2 relatively decline. More specifically, as shown in FIG. 12, in the second cycle T2 in which the second nozzle 2 to fourth nozzle 4 discharge the liquid droplets at the same timing, there occurs relative delay (solid line circle with respect to broken-line circle of second nozzle 2) of the liquid droplets discharged from the second nozzle 2 with respect to the liquid droplets discharged from the third nozzle 3 and the fourth nozzle 4 (i.e., an adjacent crosstalk phenomenon occurs). Likewise, in the third cycle T3, speed of the liquid droplets discharged from the first nozzle 1 and the third nozzle 3 relatively decline, and there occurs relative delay of the liquid droplets discharged from the first nozzle 1 and the third nozzle 3 (i.e., the adjacent crosstalk phenomenon occurs).

Thus, as shown in FIG. 13, impacts of the liquid droplets from a discharging nozzle adjacent to a non-discharging nozzle become delayed, intervals between adjacent dots become disarrayed, and image quality declines. Significant disarray is particularly observed with respect to a line image.

Figure 14:
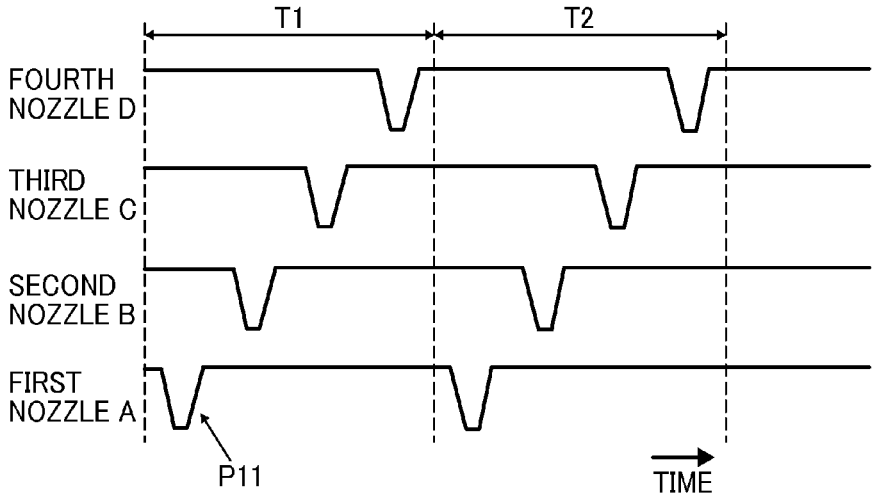
FIG. 14 is a graph of an application example of discharging pulses with respect to pressure generating units of four nozzles, continuously arranged in a direction of a nozzle array, of comparative example 2.
Figure 15:
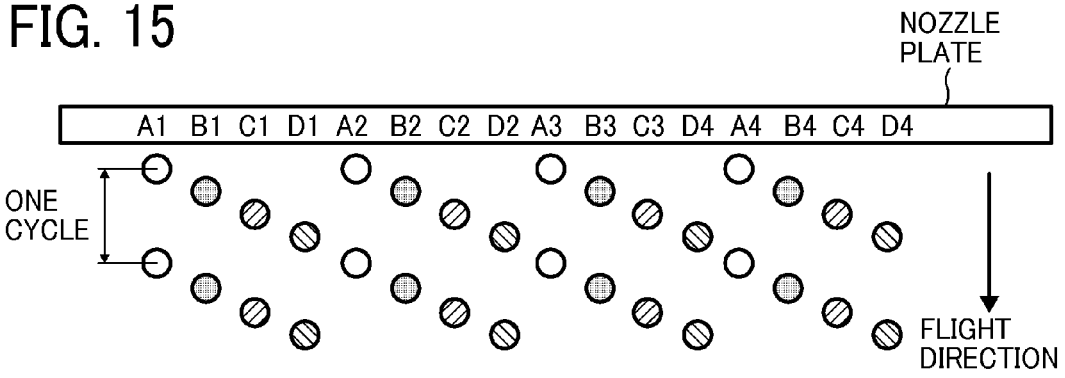
FIG. 15 is schematic view of a state of flight of liquid droplets of comparative example 2.
Figure 16:
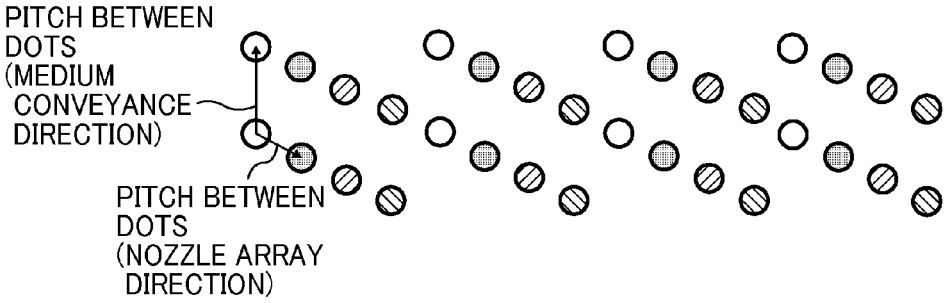
FIG. 16 is schematic view of a state of impact of the liquid droplets to a recording medium with respect to comparative example 2.

The following is a description of comparative example 2 with reference to FIG. 14 to FIG. 16. FIG. 14 is a graph of an application example of discharging pulses with respect to pressure generating units of four nozzles (i.e., first nozzle A to fourth nozzle D), continuously arranged in a direction of a nozzle array, of comparative example 2. FIG. 15 is schematic view of a state of flight of liquid droplets of comparative example 2. FIG. 16 is schematic view of a state of impact of the liquid droplets to a recording medium 10 with respect to comparative example 2.

In comparative example 2, a timing of application of a discharging pulse P11 with respect to each of the pressure generating units of the four nozzles is shifted within one cycle (i.e., first cycle T1). More specifically, the discharging pulse P11 is not applied to adjacent nozzles at the same time.

With the configuration of comparative example 2, as shown in FIG. 15, a length of one cycle becomes long and driving frequency declines. Accordingly, there is decline with respect to printing speed.

As shown in FIG. 16, shifting that correspond to four discharging timings of the four nozzles are needed in a direction of conveyance of the recording medium 10. Dots from adjacent nozzles are arranged diagonally in the direction of the nozzle array. Thus, pitch between dots increase and decline in image density occurs. To obtain a solid density in comparative example 2, there is a need to increase a dot diameter by increasing an amount of discharging liquid to fill spaces between dots. However, if the dot diameter is increased, granularity declines and image quality declines.

Compared to comparative example 1 and comparative example 2, the exemplary embodiments of the present invention employ, in the context of adjacent nozzles, the first discharging pulse P1 to make one nozzle discharge the liquid droplets and the second discharging pulse P2 to make the other nozzle discharge the liquid droplets. Thus, the adjacent crosstalk phenomenon is suppressed and decline of image quality is suppressed. In addition, increase of driving cycles is suppressed. Accordingly, decline of printing speed due to decline of driving frequency is suppressed.

It is to be noted that in a case of superimposing multiple colors to form an image, if impact points of dots are out of alignment, color shade varies according to whether or not superimposition of the dots of different colors are aligned. In the above-described case, when an amount of a discharged liquid is large and an area of a recording medium 10 covered by the formed dots becomes larger, an amount of variation of color shade in the image is made smaller in relation to an amount of deviation of the impact points of the dots. Accordingly, when the amount of the discharged liquid is small and the area of the recording medium 10 covered by the formed dots becomes smaller, the amount of variation of color shade in the image is made larger in relation to the context of the amount of deviation of the impact points of the dots. Further, the smaller the amount of the discharged liquid to form the dots, the larger a variation with respect to discharging properties (e.g., speed, the amount of discharging liquid) due to the adjacent crosstalk phenomenon. Accordingly, there is more variation of color shade in the image with smaller liquid droplets. Further, there is more variation of color shade in the image with respect to small liquid droplets for high quality images.

In the exemplary embodiments of the present invention, the size of the liquid droplets of the first discharging pulse P1 and the second discharging pulse P2 are the small liquid droplets. Further, in the exemplary embodiments of the present invention, variation of color shade is suppressed by employing the above-described first discharging pulse P1 and the above-described second discharging pulse P2. In addition, length of the driving cycles is prevented from becoming long by not using the medium liquid droplets and the large liquid droplets.

In the exemplary embodiments of the present invention, discharging pulses (e.g., the first discharging pulse P1 and the second discharging pulse P2) that are applied differ between the even number nozzles and the odd number nozzles. Thus, applying the discharging pulses (e.g., the first discharging pulse P1 and the second discharging pulse P2) that are different between adjacent nozzles is possible with a simple control.

Figure 17:
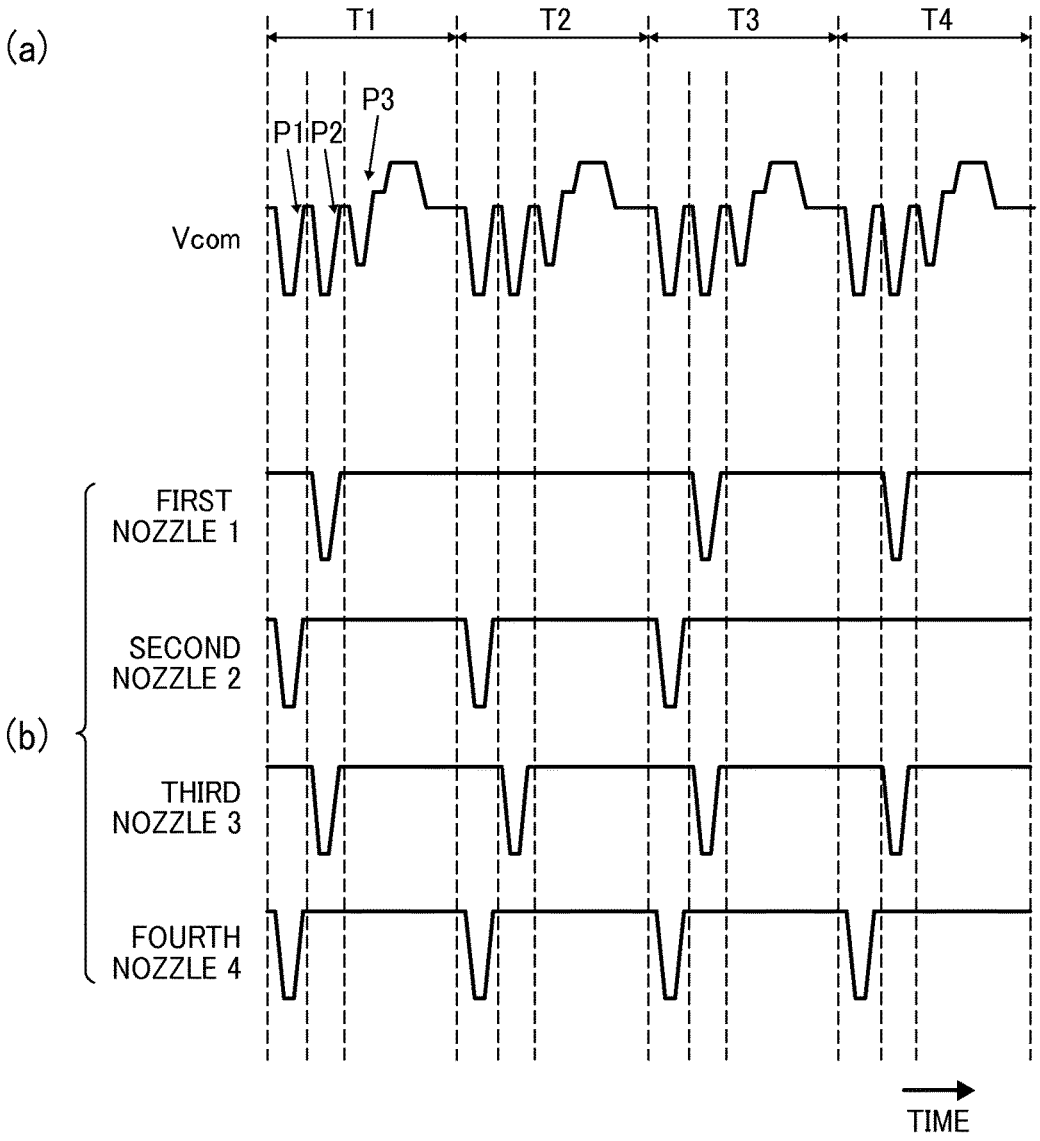
FIG. 17 is a graph of a common driving waveform and driving signals applied to pressure generating units of four nozzles, continuously arranged in a direction of a nozzle array, of example 2 according to an embodiment of the present invention.

The following is a description of example 2 according to an embodiment of the present invention with reference to FIG. 17. FIG. 17 is a graph of a common driving waveform Vcom and driving signals applied to pressure generating units of four nozzles, continuously arranged in a direction of a nozzle array, of example 2.

In example 2, the common driving waveform Vcom includes a first driving pulse P1, a second driving pulse P2, and a third driving pulse P3. This is applied to the above-described example 1. The first driving pulse P1 and the second driving pulse P2 are employed for small liquid droplets, and the third driving pulse P3 is employed for other than small liquid droplets.

Example 2 obtains the same effects as the above-described example 1.

Figure 18:
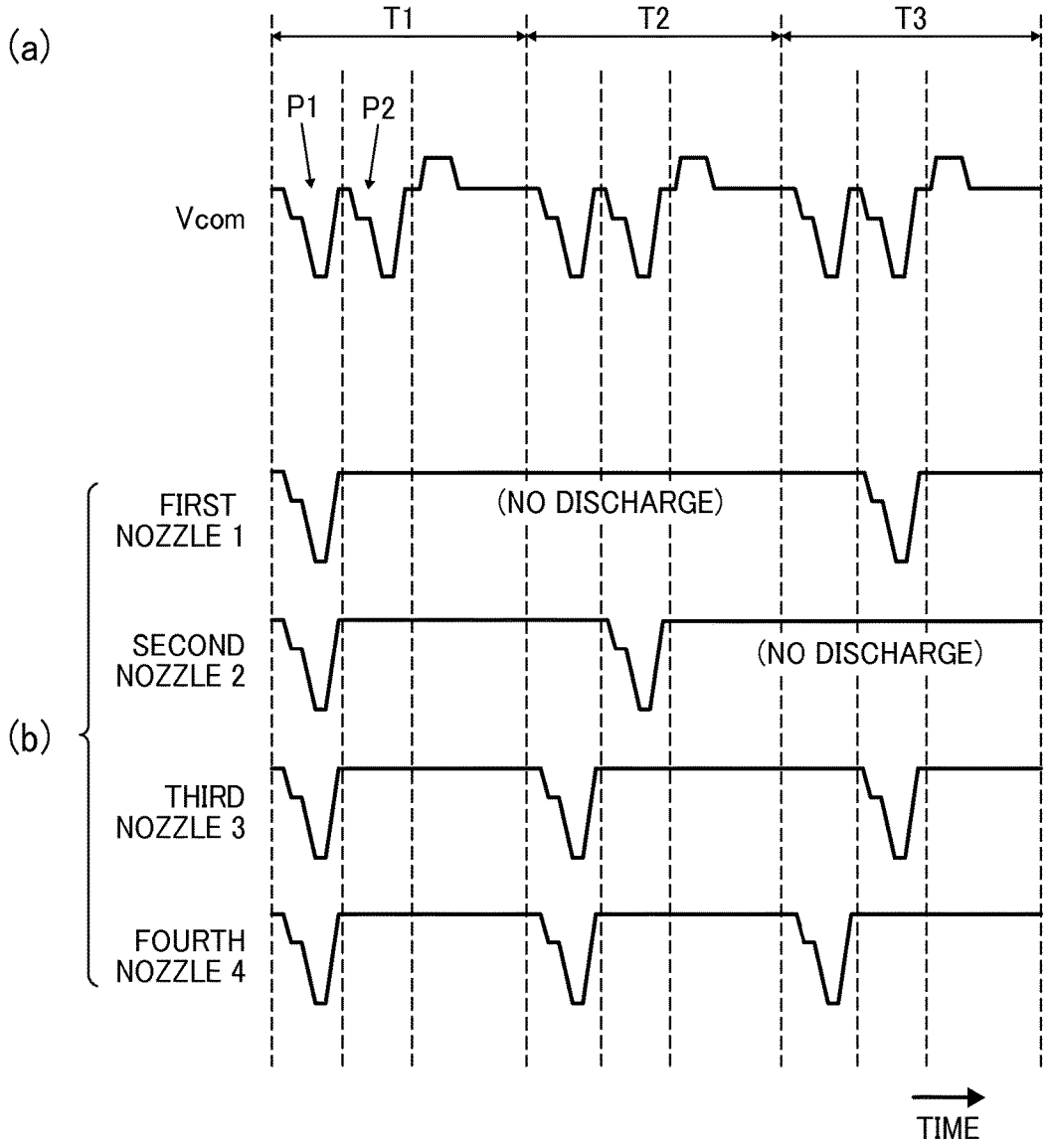
FIG. 18 is a graph of a common driving waveform and driving signals applied to pressure generating units of four nozzles, continuously arranged in a direction of a nozzle array, of example 3 according to an embodiment of the present invention.

The following is a description of example 3 according to an embodiment of the present invention with reference to FIG. 18. FIG. 18 is a graph of a common driving waveform Vcom and driving signals applied to pressure generating units of four nozzles, continuously arranged in a direction of a nozzle array, of example 3.

In example 3, in a context of adjacent nozzles, determination of whether an adjacent nozzle is a discharging nozzle that discharges liquid droplets or is a non-discharging nozzle that does not discharge liquid droplets is conducted. When the adjacent nozzle is the discharging nozzle, a first discharging pulse P1 is selected and applied. When the adjacent nozzle is the non-discharging nozzle, a second discharging pulse P2 is selected and applied.

Whether or not the adjacent nozzle is the discharging nozzle or the non-discharging nozzle can be determined from a printing data.

Discharging energy of the second discharging pulse P2, that is applied to the pressure generating unit of the adjacent nozzle, when the adjacent nozzle is the non-discharging nozzle is stronger than the first discharging pulse P1, that is applied to the pressure generating unit of the adjacent nozzle, when the adjacent nozzle is the discharging nozzle.

Accordingly, even when the adjacent nozzle is the non-discharging nozzle and pressure with respect to an individual liquid chamber adjacent to the adjacent nozzle is difficult to increase, by applying the second discharging pulse P2 that has stronger discharging energy, decline of speed of the liquid droplets discharged from a nozzle of the individual liquid chamber, in which pressure is difficult to increase, is reduced.

It is to be noted that the strength of discharging energy of the discharging pulses (i.e., first discharging pulse P1, second discharging pulse P2) is set so that the liquid droplets impact an impacting surface at almost the same time ("almost the same time" is defined as including the liquid droplets impacting the impacting surface at the same time) like the above-described example 1.

Example 3 obtains the same effects as the above-described example 1.

Figure 19:
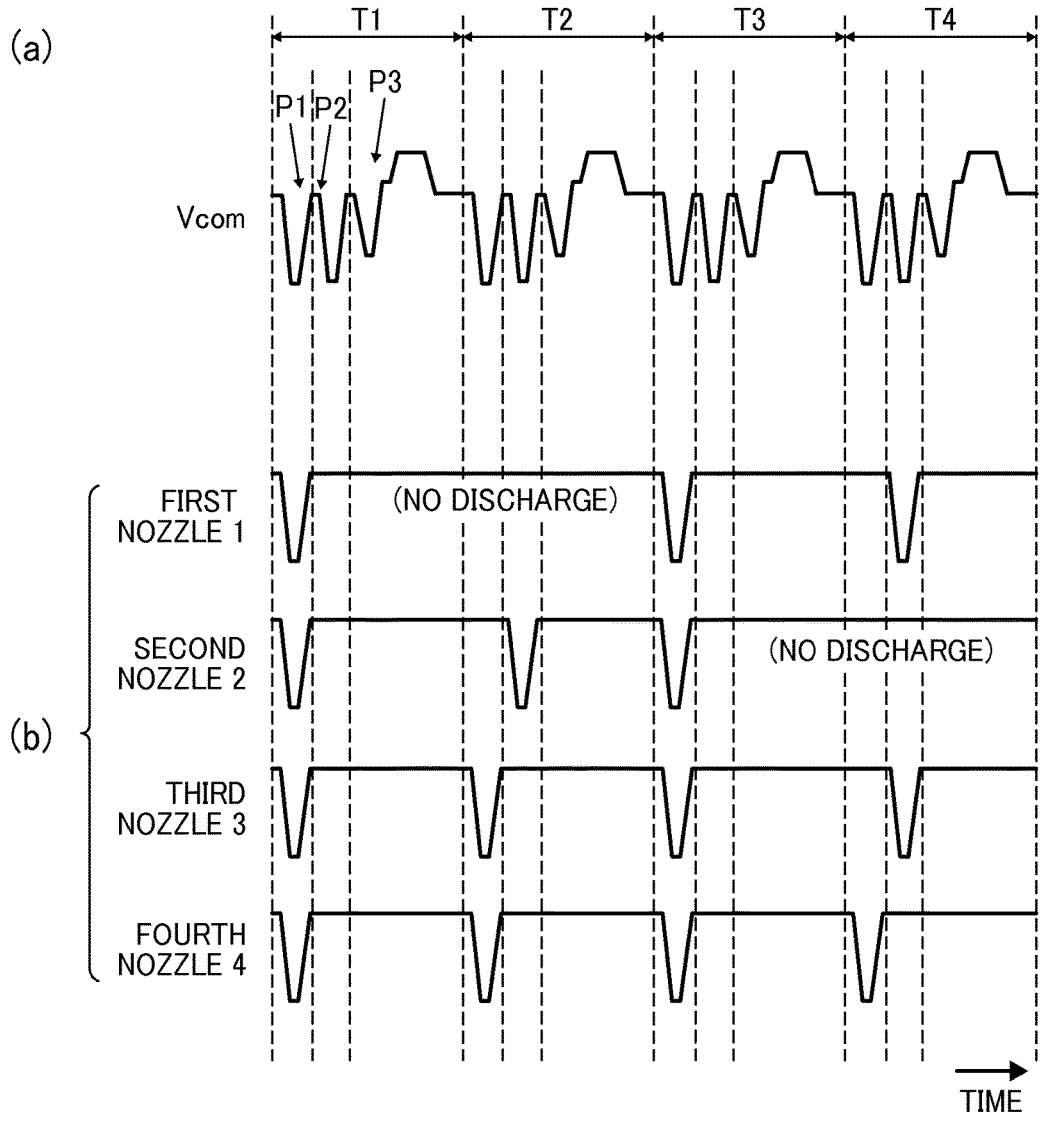
FIG. 19 is a graph of a common driving waveform and driving signals applied to pressure generating units of four nozzles, continuously arranged in a direction of a nozzle array, of example 4 according to an embodiment of the present invention.

The following is a description of example 4 according to an embodiment of the present invention with reference to FIG. 19. FIG. 19 is a graph of a common driving waveform Vcom and driving signals applied to pressure generating units of four nozzles, continuously arranged in a direction of a nozzle array, of example 4.

In example 4, the common driving waveform Vcom includes a first driving pulse P1, a second driving pulse P2, and a third driving pulse P3. This is applied to the above-described example 3. The first driving pulse P1 and the second driving pulse P2 are employed for small liquid droplets, and the third driving pulse P3 is employed for other than small liquid droplets.

Example 4 obtains the same effects as the above-described example 3.

In view of the foregoing, the present invention does not increase pitch between dots and reduces the adjacent cross-talk-like phenomenon.

It is to be noted that in this disclosure, the terms "sheet", "recording medium", "medium", "recording sheet", and "sheet for recording" are used herein as synonyms for one another. Further, the terms "image forming", "recording", "printing", "image recording" and "image printing" are used herein as synonyms for one another.

The term "image forming apparatus" refers to an apparatus that discharges liquid on a recording medium to form an image on the recording medium. The term "image forming" includes providing not only meaningful images such as characters and figures but meaningless images such as patterns to a recording medium (in other words, the term "image forming" also includes only causing liquid droplets to land on the recording medium).

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

What is claimed is:

1. An image forming apparatus, comprising:

a liquid discharging head unit including multiple nozzles arranged in a predetermined nozzle arrangement direction to discharge liquid droplets, individual liquid chambers communicated to the multiple nozzles, and pressure generating units to generate pressure applied to a liquid in the individual liquid chambers; and a head drive control unit to generate a common driving waveform including multiple discharging pulses arranged in time series within one driving cycle of discharging liquid droplets of the liquid, to select at least one of the multiple discharging pulses from the common driving waveform, and to apply the selected at least one of the discharging pulses to the pressure generating units, wherein the common driving waveform, generated by the head drive control unit, includes at least a first discharging pulse and a second discharging pulse, which occurs in time series to, and not overlapping with, the first discharging pulse within the same driving cycle of the common driving waveform, for discharging liquid droplets of same size, and when discharging liquid droplets of the same size from two adjacent nozzles of the multiple nozzles that are adjacent in the predetermined nozzle arrangement direction, the head drive control unit applies the first discharging pulse to the pressure generating unit of one nozzle of the adjacent nozzles and applies the second discharging pulse, which is in time series to, and not overlapping with, the first discharging pulse within the same driving cycle of the common driving waveform, to the pressure generating unit of the other nozzle of the adjacent nozzles, and wherein the liquid droplets discharged with the first discharging pulse and the liquid droplets discharged with the second discharging pulse impact an impacting surface at the same time.

2. The image forming apparatus of claim 1, wherein when the multiple nozzles are classified into odd number nozzles and even number nozzles, the head drive control unit applies the first discharging pulse to the pressure generating units of either the odd number nozzles or the even number nozzles and the second discharging pulse to the pressure generating units of the remaining odd number nozzles or the even number nozzles.

3. The image forming apparatus of claim 1, wherein when the adjacent nozzles of the multiple nozzles are classified into a discharging nozzle and an non-discharging nozzle, the head drive control unit applies the first discharging pulse to the pressure generating unit of either the discharging nozzle or the non-discharging nozzle and the second discharging pulse to the pressure generating unit of the remaining discharging nozzle or the non-discharging nozzle.

4. The image forming apparatus of claim 1, wherein the first discharging pulse and the second discharging pulse cause the adjacent nozzles discharge liquid droplets of the smallest size, relatively.

5. The image forming apparatus of claim 1, wherein whenever the first discharging pulse is being applied to the pressure generating unit of the one nozzle of the adjacent nozzles, the first discharging pulse is not applied to the pressure generating unit of the other nozzle of the adjacent nozzles, and whenever the second discharging pulse is being applied to the pressure generating unit of the other nozzle of the adjacent nozzles, the second discharging pulse is not applied to the pressure generating unit of the one nozzle of the adjacent nozzles.

6. A head drive method of driving a liquid discharging head unit including multiple nozzles arranged in a predetermined nozzle arrangement direction to discharge liquid droplets, individual liquid chambers communicated to the multiple nozzles, and pressure generating units to generate pressure applied to a liquid in the individual liquid chambers, the method comprising:

generating a common driving waveform including at least a first discharging pulse and a second discharging pulse, which occurs in time series to, and not overlapping with, the first discharging pulse within the same driving cycle of the common driving waveform, for discharging liquid droplets of same size; and applying, when discharging liquid droplets of the same size from adjacent nozzles of the multiple nozzles that are adjacent in the predetermined nozzle arrangement direction, the first discharging pulse to the pressure generating unit of one nozzle of the adjacent nozzles and applying the second discharging pulse, which is in time series to, and not overlapping with, the first discharging pulse within the same driving cycle of the common driving waveform, to the pressure generating unit of the other nozzle of the adjacent nozzles, wherein the liquid droplets discharged with the first discharging pulse and the liquid droplets discharged with the second discharging pulse impact an impacting surface at the same time.

7. The head drive method of claim 6, wherein whenever the first discharging pulse is being applied to the pressure generating unit of the one nozzle of the adjacent nozzles, the first discharging pulse is not applied to the pressure generating unit of the other nozzle of the adjacent nozzles, and whenever the second discharging pulse is being applied to the pressure generating unit of the other nozzle of the adjacent nozzles, the second discharging pulse is not applied to the pressure generating unit of the one nozzle of the adjacent nozzles.

* * * * *